US010808984B2

(12) United States Patent
Hjortland

(10) Patent No.: US 10,808,984 B2
(45) Date of Patent: Oct. 20, 2020

(54) SELF-OPTIMIZING SUBCOOLER CONTROL

(71) Applicant: Heatcraft Refrigeration Products LLC, Stone Mountain, GA (US)

(72) Inventor: Andrew Hjortland, Decatur, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 118 days.

(21) Appl. No.: 16/257,880

(22) Filed: Jan. 25, 2019

(65) Prior Publication Data

US 2020/0240698 A1 Jul. 30, 2020

(51) Int. Cl.

| | |
|---|---|
| ***F25D 17/02*** | (2006.01) |
| ***F25B 40/02*** | (2006.01) |
| ***F25B 25/02*** | (2006.01) |

(52) U.S. Cl.

CPC ..... *F25D 17/02* (2013.01); *F25B 25/02* (2013.01); *F25B 40/02* (2013.01)

(58) Field of Classification Search

CPC ..... F25B 25/02; F25B 40/02; F25B 2400/13
See application file for complete search history.

(56) References Cited

U.S. PATENT DOCUMENTS

| | | | | |
|---|---|---|---|---|
| 5,095,712 | A | 3/1992 | Narreau | |
| 6,820,434 | B1 | 11/2004 | Gutheim et al. | |
| 2015/0027139 | A1* | 1/2015 | Lin | F25B 49/02 62/56 |
| 2019/0078818 | A1* | 3/2019 | Khaled | F25B 41/04 |

FOREIGN PATENT DOCUMENTS

| | | |
|---|---|---|
| EP | 2083230 A2 | 7/2009 |
| EP | 2083230 A3 | 1/2011 |

OTHER PUBLICATIONS

European Patent Office, Communication pursuant to Article (94(3) EPC, Application No. 20151762.0, dated May 28, 2020, 6 pages.
European Patent Office, Extended European Search Report, Application No. 20151762.0, dated Mar. 20, 2020, 9 pages.

* cited by examiner

*Primary Examiner* — Marc E Norman
*Assistant Examiner* — Schyler S Sanks
(74) *Attorney, Agent, or Firm* — Baker Botts L.L.P.

(57) ABSTRACT

According to certain embodiments, a method comprises determining a liquid outlet temperature setpoint for refrigerant discharged from a liquid outlet of a subcooler. The liquid outlet corresponds to a hot-side path of the subcooler that receives refrigerant directly from a tank, cools the refrigerant by an exchange of heat with a cold-side path of the subcooler that receives the refrigerant from the tank via an inlet expansion valve, and discharges the refrigerant to an evaporator via an outlet expansion valve. The method further comprises determining a superheat setpoint for the refrigerant discharged to a compressor via a vapor outlet of the cold-side path. The superheat setpoint is determined based on the liquid outlet temperature setpoint. The method further comprises adjusting a temperature of the refrigerant discharged to the compressor based on the superheat setpoint.

20 Claims, 7 Drawing Sheets

SELF-OPTIMIZING SUBCOOLER CONTROL

TECHNICAL FIELD

This disclosure relates generally to a climate control system. More specifically, this disclosure relates to a refrigeration system including a subcooler.

BACKGROUND

Refrigeration systems can be used to regulate the environment within an enclosed space. Various types of refrigeration systems, such as residential and commercial, may be used to maintain cold temperatures within an enclosed space such as a refrigerated case. An example of a refrigerated case includes a grocery store case that stores fresh or frozen food products. To maintain cold temperatures within refrigerated cases, refrigeration systems control the temperature and pressure of refrigerant as it moves though the refrigeration system. When controlling the temperature and pressure of the refrigerant, refrigeration systems consume power. It is generally desirable to operate refrigeration systems efficiently in order to avoid wasting power.

SUMMARY OF THF DISCLOSURE

Refrigeration systems cycle refrigerant to cool spaces, such as residential dwellings, commercial buildings, and/or refrigeration units. Typical refrigeration systems include tanks, evaporators, compressors, and condensers. The tank stores refrigerant, which is first cycled through the evaporator. The evaporator uses the refrigerant to cool a space proximate the loads by absorbing heat. Thus, the refrigerant leaving the evaporator is warmer than the refrigerant entering the evaporator. The refrigerant is then directed to the compressor. The compressor compresses the refrigerant to concentrate the absorbed heat so that the condenser can more easily remove the heat from the refrigerant. The refrigerant next cycles through the condenser, which removes heat from the refrigerant. From the condenser, the refrigerant cycles back to the tank, and the cycle begins again.

A refrigeration system may include a subcooler, which may increase capacity of the evaporator by cooling the refrigerant that leaves the condenser before the refrigerant enters the evaporator. Typically, subcoolers provide constant liquid outlet temperature throughout the year. For some loads and ambient conditions, providing a constant liquid outlet temperature may be sub-optimal. Overcooling the liquid may result in diminished returns, and thus a lack of efficiency. Furthermore, certain known refrigeration systems that include a subcooler require two expansion valves. The first expansion valve controls vapor outlet superheat while the second valve controls subcooling and the rate at which refrigerant is discharged to the evaporator to cool refrigerated cases. However, using two valves adds cost and complexity to the system.

This disclosure contemplates an unconventional cooling system that minimizes power consumption and increases system efficiency by determining optimal liquid subcooling based on ambient temperature and load. Furthermore, this disclosure contemplates using a single valve to control vapor outlet superheat and maintain liquid outlet setpoint, which is dependent on the degree of subcooling. Certain embodiments of the system will be described below.

According to certain embodiments, a system comprises a subcooler comprising a first path, a second path, and a controller. The first path is adapted to cool a refrigerant of the second path by an exchange of heat. The first path comprises a first inlet adapted to receive the refrigerant from a tank via a first expansion valve and a vapor outlet adapted to discharge the refrigerant to a compressor. The second path comprises a second inlet adapted to receive the refrigerant from the tank and a liquid outlet adapted to discharge the refrigerant to an evaporator via a second expansion valve. The controller is operable to determine a liquid outlet temperature setpoint for the refrigerant discharged from the liquid outlet and, based on the liquid outlet temperature setpoint, determine a superheat setpoint for the refrigerant discharged from the vapor outlet to the compressor. The controller is further operable to adjust a temperature of the refrigerant discharged from the vapor outlet based on the superheat setpoint.

According to another embodiment, a controller for a heating, ventilation, and air conditioning (HVAC) system comprises a non-transitory computer-readable medium storing logic and processing circuitry operable to execute the logic. The controller is operable to determine a liquid outlet temperature setpoint for refrigerant discharged from a liquid outlet of a subcooler. The liquid outlet corresponds to a hot-side path of the subcooler. The hot-side path receives refrigerant directly from a tank, cools the refrigerant by an exchange of heat with a cold-side path of the subcooler, and discharges the refrigerant from the liquid outlet to an evaporator via an outlet expansion valve. The controller is further operable to determine a superheat setpoint for the refrigerant discharged to a compressor via a vapor outlet of the cold-side path. The cold-side path receives the refrigerant from the tank via an inlet expansion valve. The superheat setpoint is determined based on the liquid outlet temperature setpoint. The controller is further operable to adjust a temperature of the refrigerant discharged to the compressor via the vapor outlet of the cold-side path based on the superheat setpoint.

In yet another embodiment, a method for use by a heating, ventilation, and air conditioning (HVAC) system comprises determining a liquid outlet temperature setpoint for refrigerant discharged from a liquid outlet of a subcooler. The liquid outlet corresponds to a hot-side path of the subcooler that receives refrigerant directly from a tank, cools the refrigerant by an exchange of heat with a cold-side path of the subcooler, and discharges the refrigerant to an evaporator via an outlet expansion valve. The method also comprises determining a superheat setpoint for the refrigerant discharged to a compressor via a vapor outlet of the cold-side path of the subcooler. The cold-side path receives the refrigerant from the tank via an inlet expansion valve. The superheat setpoint is determined based on the liquid outlet temperature setpoint. The method further comprises adjusting a temperature of the refrigerant discharged to the compressor via the vapor outlet of the cold-side path based on the superheat setpoint.

Certain embodiments may provide one or more technical advantages. For example, power consumption may be minimized by determining optimal liquid subcooling based on ambient condition and load. Additionally, certain embodiments conserve cost by using one valve as opposed to two.

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 7 of the drawings, like numerals being used for like and corresponding parts of the various drawings.

Generally, a refrigeration cycle includes circulating refrigerant though one or more refrigeration components, including at least one compressor, a heat exchanger (e.g., a condenser), at least one valve, and one or more evaporators. To ensure the system operates as intended, each system requires sufficient power, which may vary based on the refrigeration load. The present disclosure contemplates a system and method for efficiency operating a refrigeration system.

Figure 1:
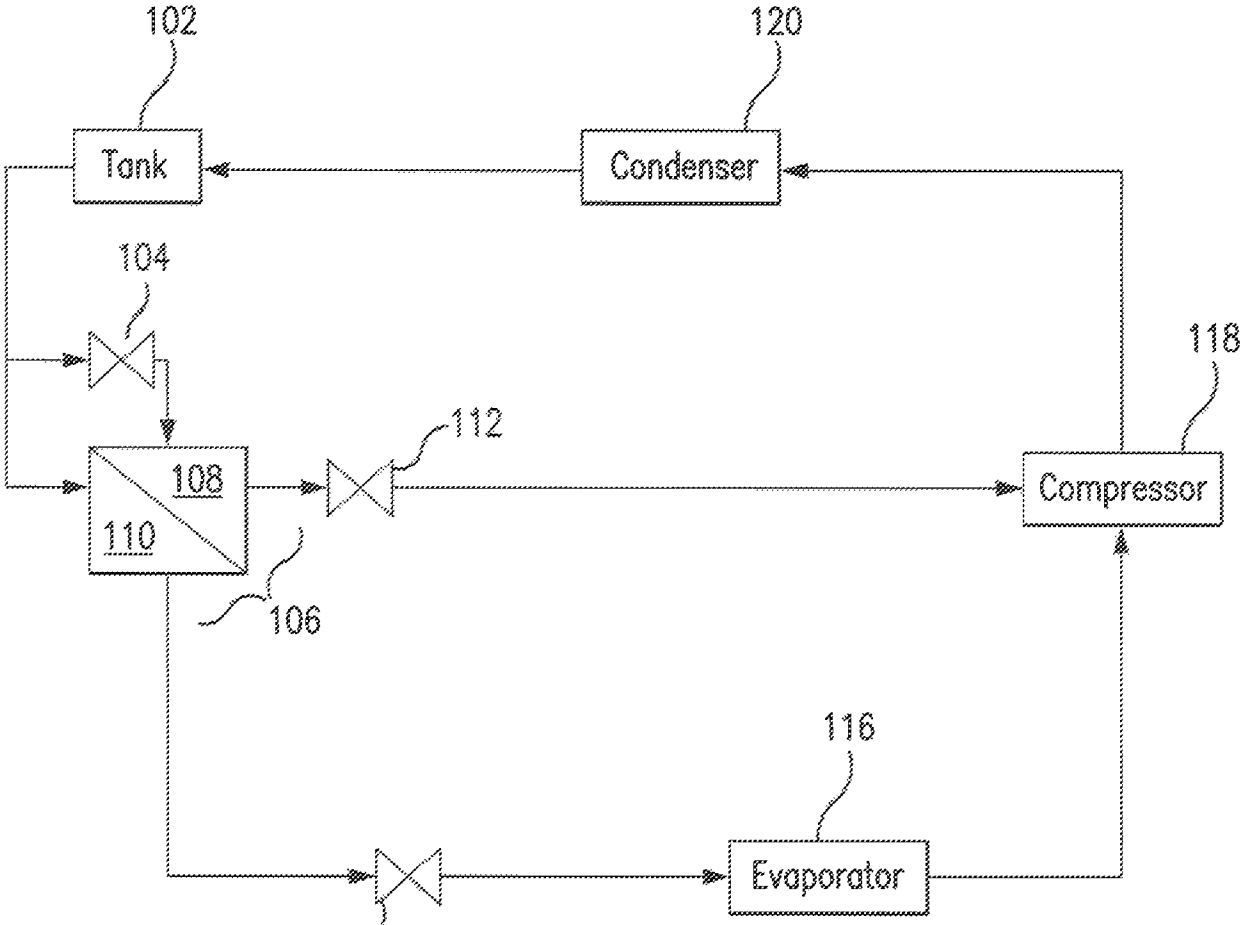
FIG. 1 illustrates a conventional refrigeration system.

For example, FIG. 1 illustrates a conventional refrigeration system. The refrigeration system of FIG. 1 includes tank 102, first expansion valve 104, subcooler 106, first path 108, second path 110, compressor path expansion valve 112, second expansion valve 114, evaporator 116, compressor 118, and condenser 120. Generally, these components cycle a refrigerant to cool spaces proximate evaporator 116.

Tank 102 stores refrigerant received from condenser 120. This disclosure contemplates tank 102 storing refrigerant in any state such as, for example, a liquid state. Refrigerant leaving tank 102 is fed to first expansion valve 104 and first path 108.

First expansion valve 104 expands the refrigerant, cooling it. Additionally, first expansion valve operates to control the amount of refrigerant entering first path 108 and to prevent liquid refrigerant from flowing back to compressor 118. As first expansion valve 104 directs more refrigerant to the first path 108, refrigerant flowing through second path 110 is cooled more, increasing the vapor outlet superheat of the first path. As further explained below, the vapor outlet superheat is controlled according to a superheat setpoint. The superheat setpoint may be used to ensure that the refrigerant entering compressor 118 is sufficiently warmer than the refrigerant's saturation temperature at the current operating pressure, which ensures that the refrigerant entering compressor 118 is a vapor (rather than a vapor/liquid mixture) in order to avoid damaging the compressor. The vapor outlet superheat may be monitored during operation of the system (e.g., using one or more sensors), and adjustments may be made to the system (e.g., opening or closing of valves) if the monitored vapor outlet superheat is too far above or below the superheat setpoint.

The refrigeration system of FIG. 1 also includes subcooler 106. Subcooler cools refrigerant cycling though refrigeration system 100. As depicted in FIG. 1, subcooler 106 comprises a first path 108 and a second path 110. In certain embodiments, first path 108 operates as a cold-side path and second path 110 operates as a hot-side path. Refrigerant moving through first path 108 cools refrigerant moving through second path 110 by an exchange of heat. As a result, the refrigerant exiting second path 110 is cooler once it reaches evaporator 116.

Refrigerant from first path 108 is directed to compressor path expansion valve 112. Compressor path expansion valve 112 operates to expand the refrigerant from first path 108, cooling it, and the rate at which refrigerant from first path 108 is directed to compressor 118. By controlling the rate at which refrigerant from first path 108 is directed to compressor 118, compressor path expansion valve 112 operates to control the liquid outlet temperature, or subcooling, to increase system capacity.

After leaving compressor path expansion valve 112, the refrigerant is directed to compressor 118. Refrigerant from second path 110 is directed to second expansion valve 114. At second expansion valve 114 the refrigerant is expanded, thus further cooled, before being directed to evaporator 116. To some extent, second expansion valve 114 may affect the cooling capacity of evaporator 116 by controlling the amount of refrigerant entering evaporator 116 and the superheat entering compressor 118. Other variables, such as compressor staging, affect the cooling capacity of evaporator 116.

Evaporator 116 is adapted to cool a space by evaporating the refrigerant. As a result, the air is cooled. The cooled air may then be circulated such as, for example, by a fan to cool a space such as, for example, a freezer and/or refrigerated shelf. As discussed above, because of the exchange of heat in subcooler 106, refrigerant from second path 110 is cooled. To evaporate this cooled refrigerant, evaporator 116 must absorb more heat from its surroundings. As a result, the space around evaporator 116 may be cooled even more. After leaving evaporator 116, refrigerant is directed to compressor 118.

Compressor 118 compresses the refrigerant from both second expansion valve 114 and compressor path expansion valve 112 by using energy to increase the temperature and pressure of the refrigerant, making it easier for condenser 120 to remove. Although this disclosure describes and depicts the refrigeration system of FIG. 1 including only one compressor 118, this disclosure recognizes that the refrigeration system of FIG. 1 may include any suitable number of compressors or condenser circuits. Compressor 118 may vary by design and/or capacity. After leaving compressor 118, the refrigerant is directed to condenser 120 where heat is removed. When heat is removed, the refrigerant is cooled. In certain configurations, condenser 120 may be positioned on a rooftop so that heat removed from the refrigerant may be discharged into the air. In another example, condenser 120 may be positioned external to a building and/or on the side of a building.

A problem occurs in the refrigeration system of FIG. 1 when subcooler 106, which is designed to provide a constant liquid outlet temperature setpoint, overcools or undercools the refrigerant. Overcooling and undercooling decrease the capacity of the system and make the system less efficient. For example, if too much refrigerant is directed to first path 108, the volume of refrigerant flowing to evaporator 116 will be too low and the capacity of evaporator 116 will decrease. Conversely, if too little refrigerant is directed to first path 108, a higher volume of the refrigerant will flow to evaporator 116 but will have less potential to absorb heat. As a result, the refrigeration system of FIG. 1 will not run at optimal efficiency and will consume more energy.

To remedy this problem, this disclosure contemplates adjusting the liquid outlet temperature setpoint to an optimal level, as determined by controller 130, by adjusting the position of expansion valve 104. Such an adjustment minimizes power consumption, making the system less dependent on ambient conditions and load. Additionally, the added cost and complexity of using two valves, first expansion valve 104 and compressor path expansion valve 112, poses an additional problem in refrigeration system 100. To remedy this problem, this disclosure contemplates eliminating compressor path expansion valve 112 and controlling both the vapor outlet superheat setpoint and the liquid outlet temperature setpoint using first expansion valve 104, thus conserving cost. The cooling system will be described in more detail using FIGS. 2 through 7.

Figure 2:
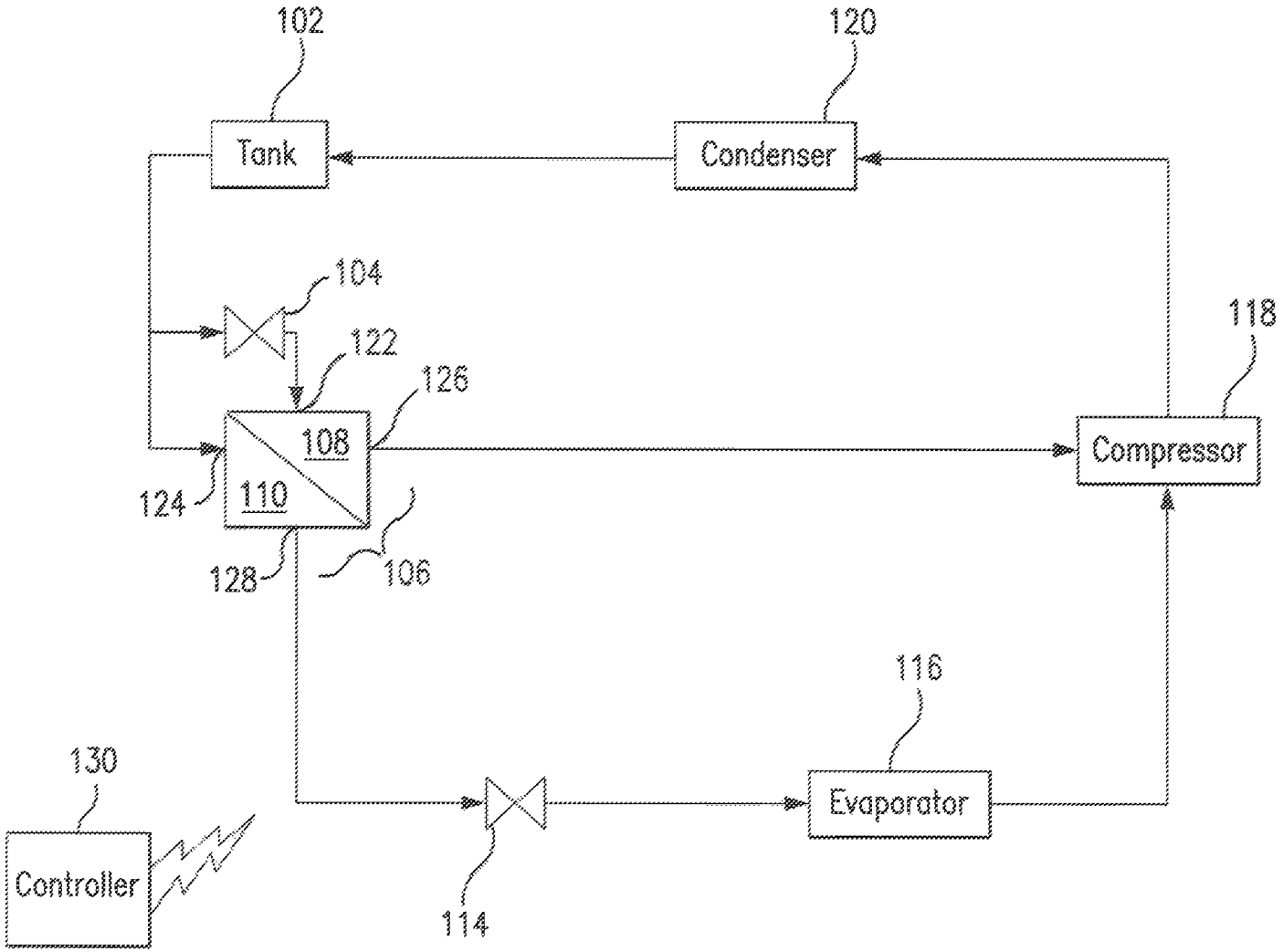
FIG. 2 illustrates a refrigeration system, in accordance with certain embodiments of the present disclosure.

FIG. 2 illustrates an example cooling system. As seen in FIG. 2, this example cooling system includes tank 102, first expansion valve 104, subcooler 106, second expansion valve 114, evaporator 116, compressor 118, condenser 120, and controller 130. Subcooler 106 includes a first path 108 (e.g., cold-side path) and a second path 110 (e.g., hot-side path). Refrigerant enters first path 108 via first inlet 122 and exits first path 108 via vapor outlet 126. Refrigerant enters second path 110 via second inlet 124 and exits second path 110 via liquid outlet 128. Generally, the example cooling system of FIG. 2 allows for adjusting the liquid outlet temperature setpoint and using the liquid outlet temperature setpoint to determine a superheat setpoint. In certain embodiments, the example cooling system of FIG. 2 also allows for the elimination of compressor path expansion valve 112. As a result, power consumption may be reduced, the system may be more responsive to changes in ambient conditions and load, and costs may be conserved.

Tank 102, subcooler 106, first path 108, second path 110, second expansion valve 114, evaporator 116, compressor 118, and condenser 120 operate similarly as they did in the refrigeration system of FIG. 1. For example, tank 102 stores refrigerant and subcooler cools refrigerant. Refrigerant in first path 108 is used to cool refrigerant in second path 110 by an exchange of heat. Second expansion valve 114 expands refrigerant from second path 110, cooling it. Evaporator 116 uses the refrigerant to cool a space. Compressor 118 compresses the refrigerant and condenser 120 removes heat from the refrigerant.

In certain embodiments, to minimize power consumption and conserve costs, first expansion valve 104 is operated to control both the vapor outlet superheat setpoint and the liquid outlet temperature setpoint.

Controller 130 determines an optimal liquid outlet temperature based on the correlation between the liquid outlet temperature setpoint and power consumption. To achieve this optimal liquid outlet temperature, controller 130 controls first expansion valve 104 and determines power consumption. For example, in certain embodiments, if the temperature of refrigerant discharged by liquid outlet 128 exceeds an optimal liquid outlet temperature setpoint, controller 130 may control first expansion valve 104 to allow more refrigerant to flow through first inlet 122 to first path 108. As a result, more cooling occurs in subcooler 106 and the refrigerant leaving second path 110 through liquid outlet 128 is cooler. Thus, evaporator 116 must use more heat from its surroundings to evaporate the refrigerant, resulting in the space around evaporator 116 being cooled even more.

In other embodiments, if the temperature of refrigerant discharged by liquid outlet 128 is less than the optimal liquid outlet temperature setpoint, controller 130 may control first expansion valve 104 to allow less refrigerant to flow through first inlet 122 to first path 108. As a result, enough refrigerant passes through second path 110 to maintain the capacity of evaporator 116, allowing the example cooling system of FIG. 2 to run at optimal efficiency and not waste energy.

Refrigerant enters subcooler 106 through either first inlet 122 or second inlet 124 and exits subcooler 106 through either vapor outlet 126 or liquid outlet 128. First inlet 122 directs refrigerant from first expansion valve 104 to first path 108. Second inlet 124 directs refrigerant from tank 102 to second path 110. The refrigerant directed to second path 110 may be warmer than the refrigerant directed to first path 108 (e.g., refrigerant from tank 102 may be directed to second path 110 without passing through an expansion valve). Vapor outlet 126 directs refrigerant from first path 108 to compressor 118. Liquid outlet 128 directs refrigerant from second path 110 to second expansion valve 114 and second expansion valve 114 directs refrigerant to evaporator 116. After leaving evaporator 116, the refrigerant flows to compressor 118. In alternative embodiments, the refrigerant exiting evaporator 116 may be combined with the refrigerant exiting vapor outlet 126 before entering compressor 118.

Modifications, additions, or omissions may be made to the example cooling system of FIG. 2. Certain components may be integrated or separated, and the example cooling system of FIG. 2 may include more, fewer, or other components. For example, the example cooling system of FIG. 2 may include sensors that sense refrigerant temperature, refrigerant pressure, power consumption and/or other properties of the example cooling system of FIG. 2. In certain embodiments, the example cooling system of FIG. 2 includes a sensor that senses refrigerant temperature at first inlet 122, a sensor that senses refrigerant temperature at vapor outlet 126, a sensor that senses refrigerant temperature at liquid outlet 128, and/or a sensor that senses ambient conditions. Controller 130 may use data from the sensors to determine the power consumption, the superheat setpoint, and/or the liquid outlet temperature setpoint.

Figure 3:
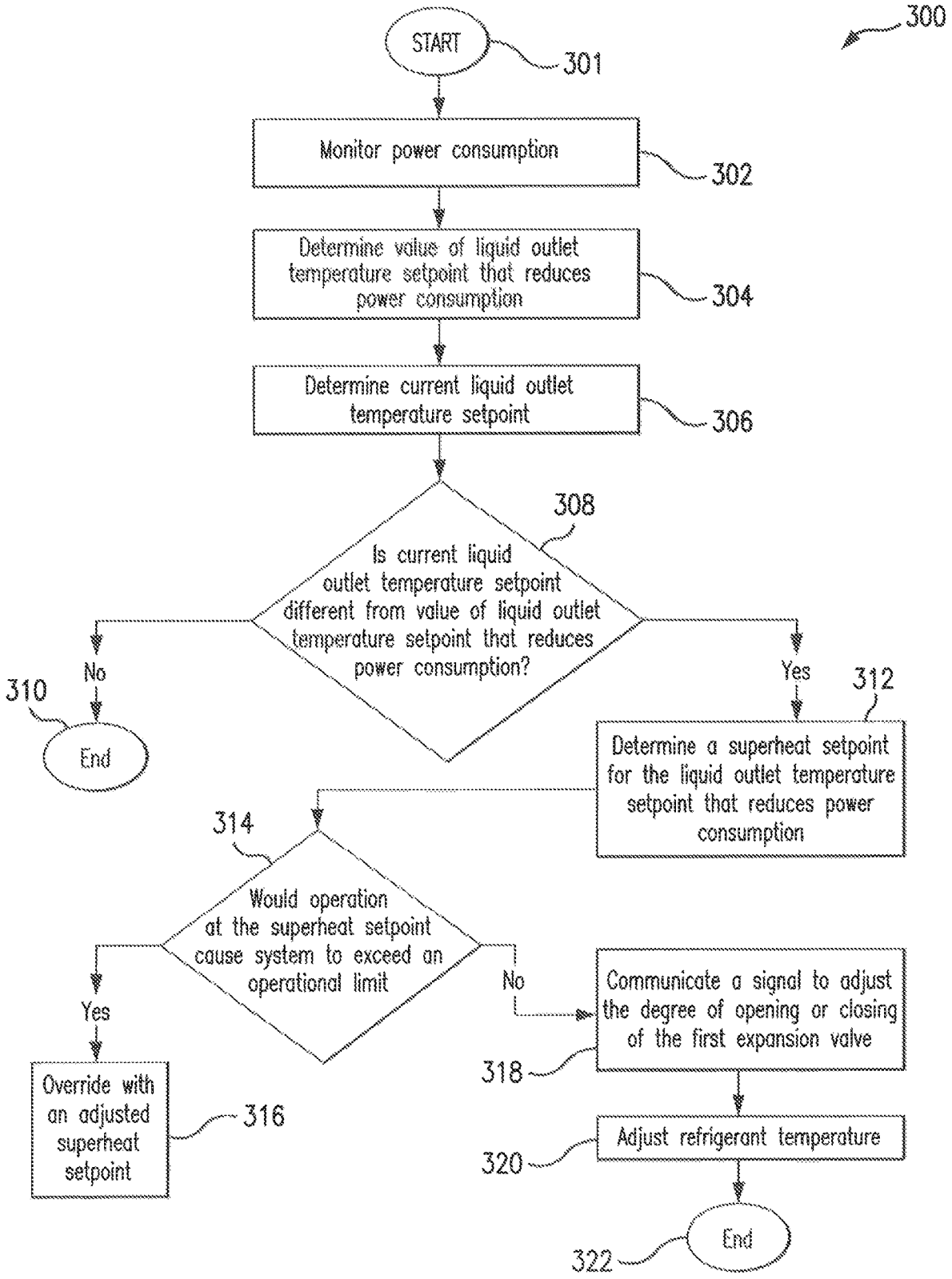
FIG. 3 is a flowchart illustrating a method for operating the refrigeration system of FIG. 2, in accordance with certain embodiments of the present disclosure.

FIG. 3 is a flowchart illustrating a method 300 for operating the refrigeration system of FIG. 2. In particular embodiments, various components of the example cooling system of FIG. 2 perform the steps of method 300. By performing the steps of method 300, power consumption may be minimized, and costs may be conserved.

A controller 130 begins by monitoring power consumption associated with a liquid outlet temperature setpoint in step 302. In step 304, the controller 130 determines a value of the liquid outlet temperature setpoint that reduces power consumption. In certain embodiments, the controller 130 uses information about a current load of the evaporator and/or a target load capacity of the evaporator in determining the liquid outlet temperature setpoint that reduces power consumption. In addition, or in the alternative, in certain embodiments the controller 130 uses information about a current and/or predicted ambient environment of the system in determining the liquid outlet temperature setpoint that reduces power consumption. Information about the current or predicted ambient environment, such as ambient temperature and/or ambient humidity where the example cooling system of FIG. 2 is located, may be determined based on information received from one or more sensors and/or based on information received over a network, such as a weather forecast received over the Internet.

At step 306, the controller 130 determines a current liquid outlet temperature setpoint. The current liquid outlet temperature setpoint may refer to the liquid outlet temperature setpoint that is currently being used by the refrigeration system 200. As discussed above, the liquid outlet temperature setpoint is used to control the temperature of refrigerant discharged from a liquid outlet 128 of a subcooler 106. The liquid outlet 128 corresponds to a hot-side path of the subcooler 106 that receives refrigerant directly from a tank 102, an example of which is illustrated by second path 110 in FIG. 2. In FIG. 2, second path 110 is considered to receive refrigerant directly from tank 102 because there is no expansion valve between tank 102 and inlet 124 to second path 110. In the absence of an expansion valve, refrigerant entering second path 110 (hot-side path) is warmer than refrigerant entering first path 108 (cold-side path, which includes expansion valve 104 to cool the refrigerant prior to entering inlet 122 to the first path 108).

In step 308, the controller 130 determines whether the current liquid outlet temperature setpoint is different from the liquid outlet temperature setpoint that reduces power consumption. If the current liquid outlet temperature setpoint is not different from a liquid outlet temperature setpoint that reduces power consumption, the method proceeds to step 310 and ends. If the current liquid outlet temperature setpoint is different from a liquid outlet temperature setpoint that reduces power consumption, the method proceeds to step 312.

In step 312, the controller 130 determines a superheat setpoint for the refrigerant discharged to a compressor via a vapor outlet of the cold-side path of the subcooler. As discussed above, the cold-side path receives the refrigerant from the tank via an inlet expansion valve. An example of the cold-side path is illustrated by first path 108 in FIG. 2, which receives refrigerant from tank 102 via inlet expansion valve 104. The superheat setpoint determined by the controller 130 in step 312 is based on the liquid outlet temperature setpoint that reduces power consumption (i.e., the value determined in step 304).

The method then proceeds to step 314, where the controller 130 determines whether the system exceeds an operational limit when operating to the superheat setpoint that was determined based on the liquid outlet temperature setpoint in step 312. In certain embodiments, the operational limit may refer to a superheat setpoint that causes an unacceptable level of risk of damaging the compressor or other component of the refrigeration system (e.g., because the superheat setpoint is too hot or too cold). As an example, the operational limit may be determined based on recommended settings or an operational envelope provided by the manufacturer of the compressor or other components of the refrigeration system. As another example, the operational limit may be determined based on monitoring the refrigeration system and detecting an alarm.

If at step 314 the system exceeds an operational limit when operating to the superheat setpoint that was determined based on the liquid outlet temperature setpoint, the method proceeds to step 316. In step 316 the controller 130 overrides the superheat setpoint with an adjusted superheat setpoint that prevents the system from exceeding the operational limit. That is, during the override operation, the controller 130 may override a superheat setpoint selected to yield an energy-efficient liquid outlet temperature with a superheat setpoint that reduces the risk of damaging the subcooler or other component of the refrigeration system.

If at step 314 the system does not exceed an operational limit when operating to the superheat setpoint that was determined based on the liquid outlet temperature setpoint, the method proceeds to step 318. In step 318, the controller 130 communicates a signal to adjust the degree of opening or closing of the first expansion valve (e.g., expansion valve 104 in FIG. 2). The controller 130 selects the degree of opening or closing of the first expansion valve 104 to cause the temperature of the refrigerant discharged via the vapor outlet 126 of the cold-side path to maintain the superheat setpoint determined at step 312, which in turn causes the temperature of the refrigerant exiting the liquid outlet 128 to maintain the liquid outlet temperature setpoint that reduces power consumption (i.e., the value determined in step 304). Thus, as a result of adjusting the degree of opening or closing of the first expansion valve 104, the liquid outlet temperature is adjusted to a value that reduces the power consumption in step 320. The method concludes in step 322.

Modifications, additions, or omissions may be made to method 300 depicted in FIG. 3. Method 300 may include more, fewer, or other steps. For example, steps may be performed in parallel or in any suitable order. While discussed as the example cooling system of FIG. 2 (or components thereof) performing the steps, any suitable component of the example cooling system of FIG. 2 may perform one or more steps of the method.

Figure 4:
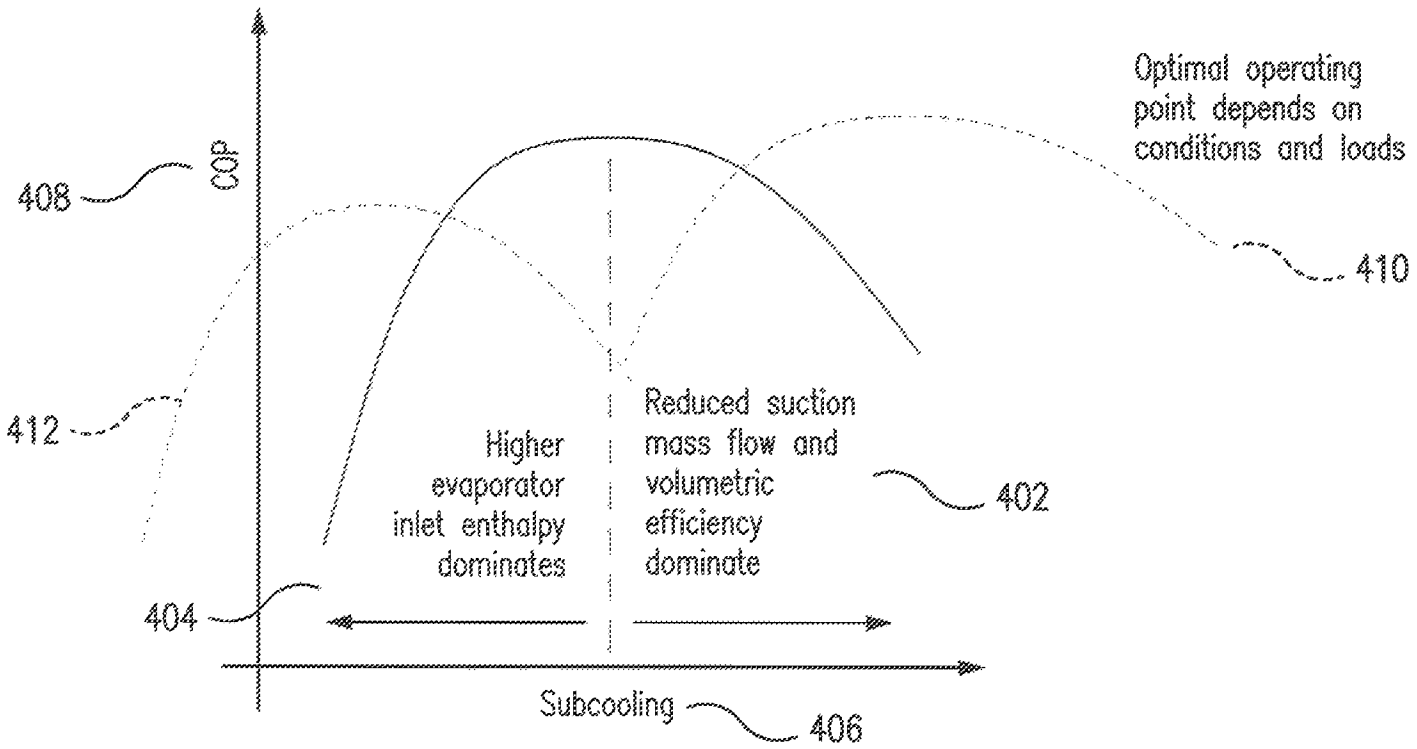
FIG. 4 is a graph illustrating a relationship between subcooling and a coefficient of performance ("COP").

FIG. 4 is a graph illustrating a relationship between subcooling 406 and a coefficient of performance 408. Coefficient of performance 408 corresponds to the ratio between useful heating or cooling and work required. As coefficient of performance 408 increases, energy consumption decreases. As shown in region 402 of FIG. 4, too much subcooling 406 may reduce suction mass flow and compressor volumetric efficiency dominates, which may reduce coefficient of performance 408 and increase power consumption compared to an optimal amount of subcooling. As shown in region 404 of FIG. 4, too little subcooling 406 may also cause higher inlet enthalpy efficiency to dominate, which may reduce coefficient of performance 408 and increase power consumption compared to the optimal amount of subcooling. To conserve energy, this disclosure contemplates determining an optimal amount of subcooling 406, which may be achieved by controlling the liquid output temperature setpoint in the manner described above with respect to FIGS. 2-3.

As discussed above, the optimal amount of subcooling 406 may vary depending on ambient conditions and load. For example, FIG. 4 illustrates a first set of conditions 410 and a second set of conditions 412. The coefficient of performance 408 peaks with more subcooling for the first set of conditions 410 and less subcooling for the second set of conditions 412. Thus, the optimal liquid outlet temperature setpoint for the first set of conditions 410 may be less than the optimal liquid outlet temperature setpoint for the second set of conditions 412.

Figure 5:
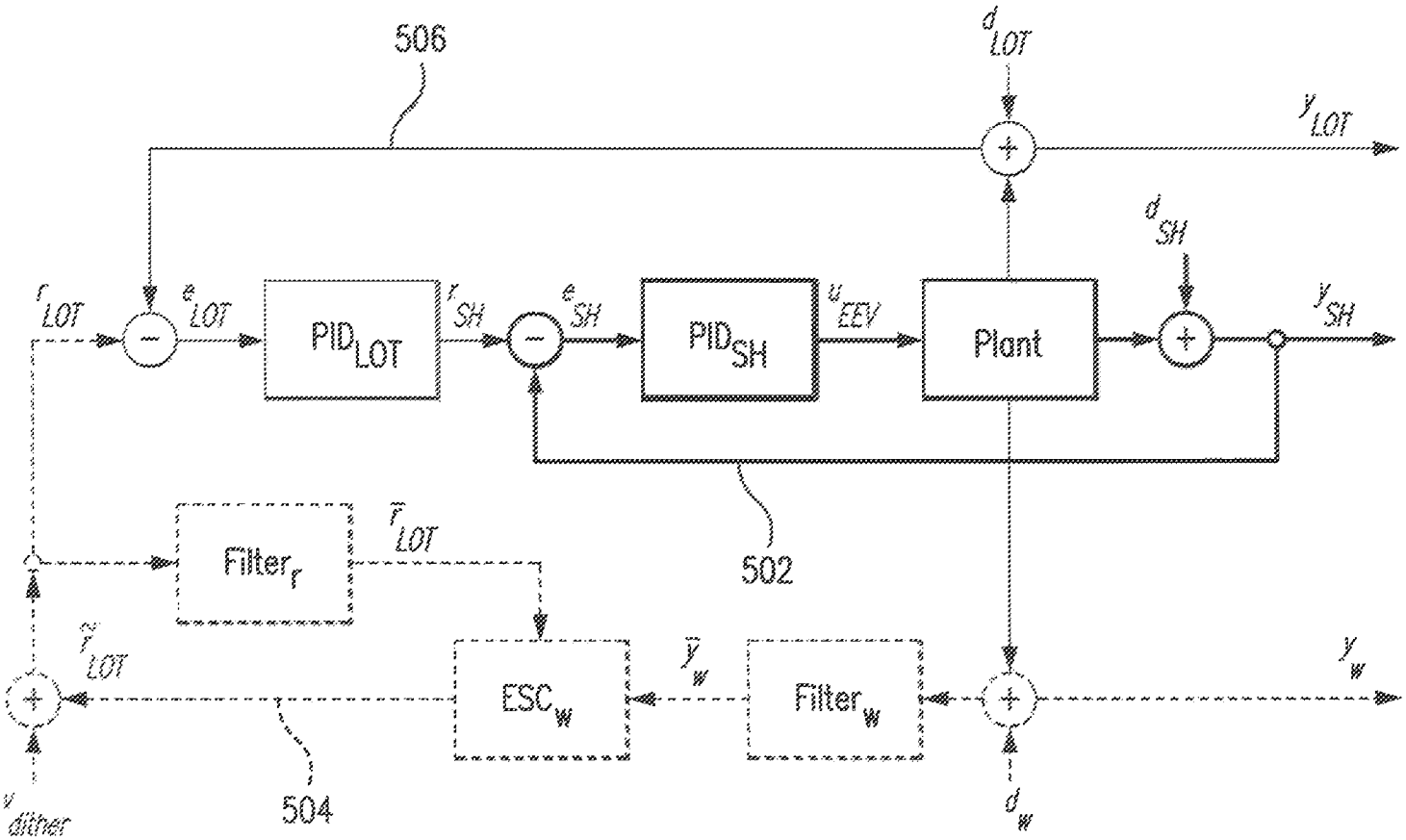
FIG. 5 illustrates a block diagram of a proposed model-free self-optimizing subcooler algorithm, in accordance with certain embodiments of the present disclosure.

FIG. 5 illustrates a block diagram of a model-free self-optimizing subcooler algorithm, in accordance with certain embodiments. In certain embodiments, the algorithm of FIG. 5 may be performed by controller 130 using proportional-integral-derivative (PID) logic to regulate temperature, pressure, and/or other process variables using a control loop feedback mechanism. In some embodiments, the algorithm of FIG. 5 may be used to implement the method of FIG. 3.

As shown in FIG. 5, the model-free self-optimizing subcooler algorithm contemplates three loops: first loop 502, second loop 506, and third loop 504. First loop 502 is used to regulate the position of first expansion valve 104 to maintain vapor outlet superheat at the superheat setpoint. Second loop 506 is used to determine a superheat setpoint based on the liquid outlet temperature control error, and to provide the superheat setpoint to first loop 502. First loop 502 may then adjust the first expansion valve 104 to maintain the vapor outlet superheat at the adjusted superheat setpoint. For example, as the superheat setpoint increases, the degree of opening of first expansion valve 104 decreases to allow less refrigerant through the cold side of subcooler 106. This will result in less liquid outlet subcooling and a higher liquid outlet temperature. Third loop 504 is used to monitor system power in response to subcooling setpoint and update the liquid outlet temperature setpoint to minimize power consumption. Third loop 504 provides an optimized liquid outlet temperature setpoint to second loop 506 to allow second loop 506 to determine the superheat setpoint. In certain embodiments, a dithering signal is added to perturb the system.

The table below describes the abbreviations shown in FIG. 5.

| Abbreviation | Description |
|---|---|
| $d_{LOT}$ | Disturbance Affecting Liquid Outlet Temperature |
| $d_{SH}$ | Disturbance Affecting Superheat |
| $d_W$ | Disturbance Affecting Power Consumption |
| $e_{LOT}$ | Liquid Outlet Temperature Control Error |
| $e_{SH}$ | Superheat Control Error |
| $ESC_W$ | Optimization logic for determining optimal Liquid Outlet Temperature Setpoint based on Power Consumption Measurements |
| $Filter_r$ | Filtering logic for Liquid Outlet Temperature Setpoint |
| $Filter_W$ | Filtering logic for Power Consumption |
| $PID_{LOT}$ | PID logic for determining Superheat setpoint |
| $PID_{SH}$ | PID logic for determining electronic expansion valve output |
| Plant | Refrigeration system |
| $r_{LOT}$ | Liquid Outlet Temperature Setpoint |
| $\tilde{r}_{LOT}$ | Predicted Optimal Liquid Outlet Temperature |
| $\bar{r}_{LOT}$ | Filtered Liquid Outlet Temperature |
| $r_{SH}$ | Superheat Setpoint |
| $u_{EEV}$ | Electronic Expansion Valve Output |
| $v_{dither}$ | Perturbation Signal applied to Liquid Outlet Temperature Setpoint to identify changes in Optimal Liquid Outlet Temperature Setpoint |
| $y_{LOT}$ | Measured Liquid Outlet Temperature |
| $y_{SH}$ | Measured Superhead |
| $y_W$ | Measured Power Consumption |
| $\bar{y}_W$ | Filtered Power Consumption |
| + | Summation |
| − | Difference |

Figure 6:
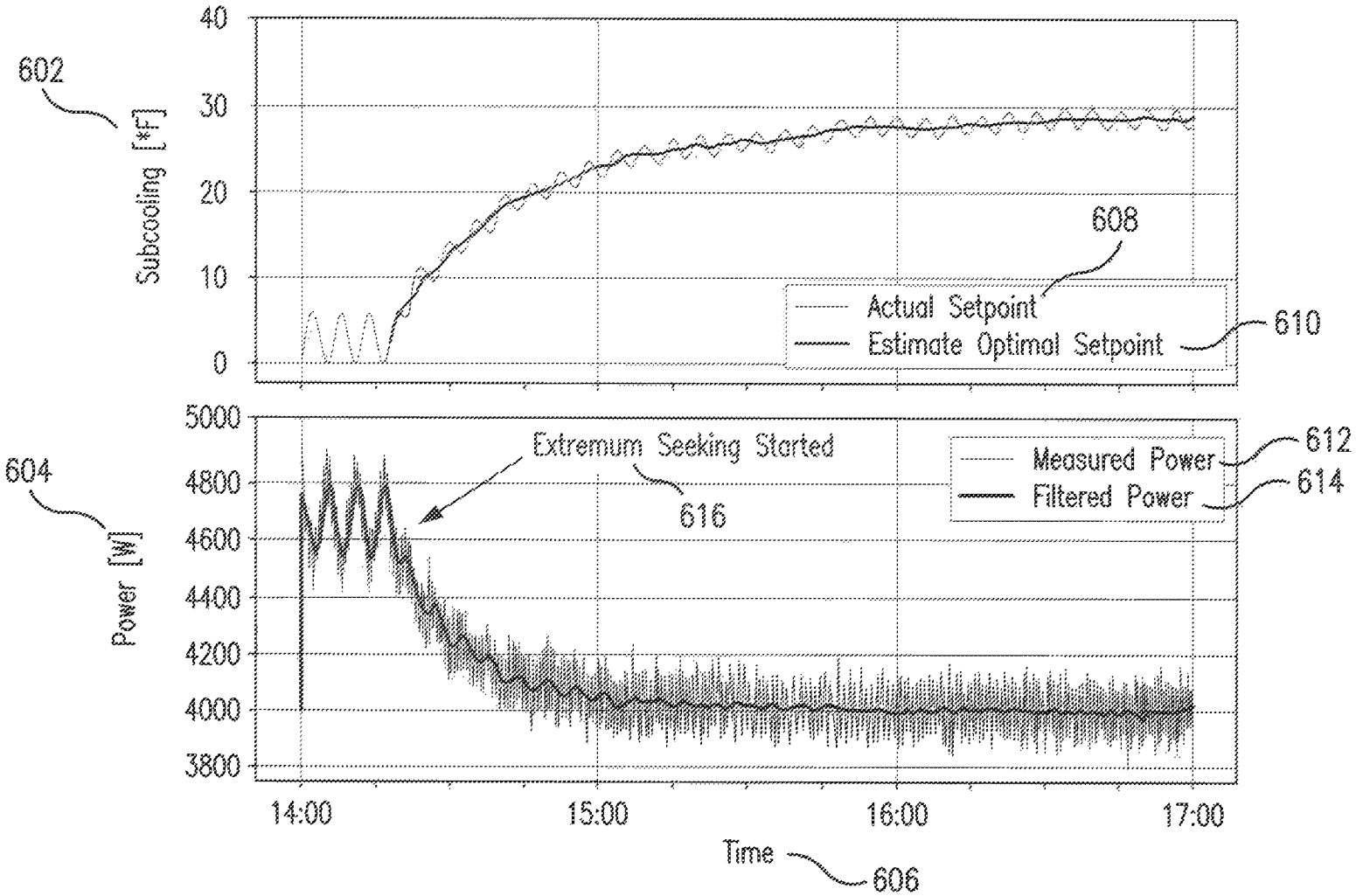
FIG. 6 illustrates simulated trends in subcooling and system power consumption after applying the proposed control algorithm to the subcooler.

FIG. 6 illustrates simulated trends in subcooling and system power consumption after applying the control algorithm, discussed above in FIG. 5, to the subcooler. In the example of FIG. 6, the control algorithm requires approximately two hours from start point 616, as indicated by time 606, to reach a relatively steady state. The actual subcooling setpoint 608 and estimate optimal subcooling setpoint 610 may then be slightly increased or decreased in order to maintain low power consumption under changing load or ambient conditions, for example, as shown in the 16:00-17:00 time range.

Figure 7:
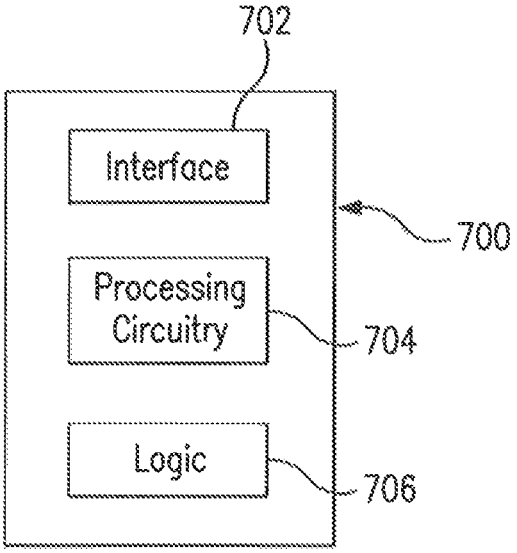
FIG. 7 illustrates an example controller operable to control one or more components of the refrigeration system of FIG. 2, in accordance with certain embodiments of the present disclosure.

FIG. 7 illustrates an example controller operable to control one or more components of system 200. For example, controller 700 may correspond to controller 130 described above with respect to FIG. 2. Controller 700 includes interface 702, processing circuitry 704, and logic 706. This disclosure contemplates interface 702, processing circuitry 704, and logic 706 being configured to perform any of the functions of controller 700 described herein. In some embodiments, each component of controller 700 is communicably coupled and the components permit instructions to be sent from controller 700 or information to be received by controller 700 to or from other components of refrigeration system 200. In some embodiments, controller 700 may provide instructions to or receive information from components of the example cooling system of FIG. 2 via an appropriate communications link (e.g., wired or wireless) or analog control signal. Generally, controller 700 controls first expansion valve 104 to adjust the flow of refrigerant to first path 108 and determines power consumption for system 200.

Interface 702 may be configured to receive information. In some embodiments, interface 702 receives information continuously. In other embodiments, interface 702 receives information periodically. As an example, and not by way of limitation, interface 702 may receive information from one or more sensors of refrigeration system 200. For example, interface 702 may receive liquid outlet temperature information from liquid outlet 128. Additionally, interface 702 may be configured to send instructions to one or more components of system 200. For example, processing circuitry 704 may generate instructions for one or more components of the example cooling system of FIG. 2 (e.g., first expansion valve 104) and interface 702 may relay those instructions to the intended component of system 200. As an example, in response to receiving instructions for first expansion valve 104, interface 702 sends the instructions to first expansion valve 104.

Processing circuitry 704 is an electronic circuitry, including, but not limited to microprocessors, application specific integrated circuits (ASIC), application specific instruction set processor (ASIP), and/or state machines, that communicatively couples to logic 706 and controls the operation of controller 700. Processing circuitry 704 may be 8-bit, 16-bit, 32-bit, 64-bit or of any other suitable architecture. Processing circuitry 704 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processing circuitry 704 may include other hardware and software that operates to control and process information. Processing circuitry 704 executes software stored on logic 706 to perform any of the functions described herein. Processing circuitry 704 controls the operation and administration of controller 700 by processing information received from various components of system 200. Processing circuitry 704 may be a programmable logic device, a microcontroller, a microprocessor, any suitable processing device, or any suitable combination of the preceding. Processing circuitry 704 is not limited to a single processing device and may encompass multiple processing devices.

Logic 706 may store, either permanently or temporarily, data, operational software, or other information for processing circuitry 704. Logic 706 may include any one or a combination of volatile or non-volatile local or remote devices suitable for storing information. For example, logic 706 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in logic 706, a disk, a CD, or a flash drive. In particular embodiments, the software may include an application executable by processing circuitry 704 to perform one or more of the functions of controller 700 described herein.

Controller 700 receives a detected temperature from liquid outlet 128. The detected temperature may be the liquid outlet temperature of the refrigerant received from liquid outlet 128. If the liquid outlet temperature is too high or too low, then the performance of system 200, including the power consumption, may be negatively affected. To improve the performance and power consumption of system 200, controller 700 may adjust the flow of refrigerant though first path 108 to adjust liquid outlet temperature.

Controller 700 determines the power consumption of system 200 (e.g., power consumption may be obtained by directly measuring power consumption, or power consumption may be calculated using other variables as inputs to a mathematical model). Additionally, controller 700 determines an optimal liquid outlet temperature based on the correlation between liquid outlet temperature setpoint and power consumption. As discussed above, in certain embodiments, the optimal liquid outlet temperature to be used as the liquid outlet temperature setpoint may depend on ambient conditions (such as air temperature or humidity of an area in which the example cooling system of FIG. 2 is located) or load (such as the load on the evaporators in order to cool a refrigerated case to a temperature that a user sets on a thermostat). Controller 700 then compares the liquid outlet temperature received to the optimal liquid outlet temperature. Based on that comparison, controller 700 adjusts the flow of refrigerant through first path 108 by controlling first expansion valve 104. For example, in certain embodiments, if liquid outlet temperature exceeds optimal liquid outlet temperature, controller 130 may control first expansion valve 104 to allow more refrigerant to flow through first inlet 122 to first path 108. As a result, the refrigerant leaving second path 110 through liquid outlet 128 is cooler, evaporator 116 must absorb more heat from its surroundings to evaporate the refrigerant, and the space around evaporator 116 is cooled even more.

In other embodiments, if liquid outlet temperature is less than optimal liquid outlet temperature, controller 130 may control first expansion valve 104 to allow less refrigerant to flow through first inlet 122 to first path 108. As a result, enough refrigerant passes through second path 110 to maintain the capacity of evaporator 116, allowing the example cooling system of FIG. 2 to run at optimal efficiency and not waste energy.

In yet another embodiment, controller 700 is further operable to, in response to determining that the example cooling system of FIG. 2 exceeds an operational limit when operating according to the superheat setpoint that was determined based on the liquid outlet temperature setpoint, override the superheat setpoint with an adjusted superheat setpoint that prevents the system from exceeding the operational limit. For example, if the superheat setpoint would cause the refrigerant received at second inlet 124 to be too hot or too cold such that there is a risk of damaging the compressor or other components of the HVAC system, controller 700 can override the determined superheat setpoint with a safe setpoint. Arbitrary limits defined by end users or operators may also be defined that provide additional safety features.

Modifications, additions, or omissions may be made to any of the methods disclosed herein. These methods may include more, fewer, or other steps, and steps may be performed in parallel or in any suitable order. While discussed as certain components of the system controller performing the steps, any suitable component or combination of components may perform one or more steps of these methods. Certain examples have been described using the modifiers "first" or "second" (e.g., first indication, second indication, first operational information, second operational information). The modifiers do not require any particular sequence (e.g., the second indication can be received before or after the first indication, and the second operational information can be communicated before or after the first operational information).

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

The invention claimed is:

1. A system comprising:

a subcooler, the subcooler comprising a first path and a second path, the first path adapted to cool refrigerant of the second path by an exchange of heat, wherein:

the first path comprises:

a first inlet adapted to receive the refrigerant from a tank via a first expansion valve; and a vapor outlet adapted to discharge the refrigerant to a compressor; and the second path comprises:

a second inlet adapted to receive the refrigerant from the tank; and a liquid outlet adapted to discharge the refrigerant to an evaporator via a second expansion valve;

the system further comprising a controller operable to:

determine a liquid outlet temperature setpoint for the refrigerant discharged from the liquid outlet;

determine a superheat setpoint for the refrigerant discharged to the compressor via the vapor outlet, the superheat setpoint determined based on the liquid outlet temperature setpoint; and adjust a temperature of the refrigerant discharged to the compressor via the vapor outlet based on the superheat setpoint.

2. The system of claim 1, wherein to adjust the temperature of the refrigerant discharged to the compressor, the controller is operable to communicate a signal to adjust the degree of opening or closing of the first expansion valve.

3. The system of claim 1, wherein the controller is operable to determine the liquid outlet temperature setpoint based at least in part on a target load capacity of the evaporator.

4. The system of claim 1, wherein the controller is further operable to:

monitor power consumption associated with the liquid outlet temperature setpoint; and adjust the liquid outlet temperature setpoint to a value that reduces the power consumption.

5. The system of claim 4, wherein the controller is further operable to:

use information about at least one of a current load of the evaporator, a target load of the evaporator, a current ambient environment of the system, and a predicted ambient environment of the system to determine the value of the liquid outlet temperature setpoint that reduces the power consumption.

6. The system of claim 1, wherein the controller is further operable to:

in response to determining that the system exceeds an operational limit when operating according to the superheat setpoint that was determined based on the liquid outlet temperature setpoint, override the superheat setpoint with an adjusted superheat setpoint that prevents the system from exceeding the operational limit.

7. The system of claim 1, wherein a refrigerant path connecting between the vapor outlet and the compressor does not include any expansion valve.

8. The system of claim 1, wherein the system further comprises:

the tank, wherein the tank is adapted to store the refrigerant;

the evaporator, wherein the evaporator is adapted to cool a load by evaporating the refrigerant, and to discharge the refrigerant to the compressor;

the compressor, wherein the compressor is adapted to receive the refrigerant from the evaporator and apply pressure to the refrigerant; and a condenser adapted to receive the refrigerant form the compressor, cool the refrigerant, and discharge the refrigerant to the tank.

9. A controller comprising a non-transitory computer-readable medium storing logic and processing circuitry operable to execute the logic, whereby the controller is operable to:

determine a liquid outlet temperature setpoint for refrigerant discharged from a liquid outlet of a subcooler, the liquid outlet corresponding to a hot-side path of the subcooler that receives refrigerant directly from a tank, cools the refrigerant by an exchange of heat with a cold-side path of the subcooler that receives the refrigerant from the tank via an inlet expansion valve, and discharges the refrigerant to an evaporator via an outlet expansion valve;

determine a superheat setpoint for the refrigerant discharged to a compressor via a vapor outlet of the cold-side path of the subcooler, the superheat setpoint determined based on the liquid outlet temperature setpoint; and adjust a temperature of the refrigerant discharged to the compressor via the vapor outlet of the cold-side path based on the superheat setpoint.

10. The controller of claim 9, further operable to:

adjust the temperature of the refrigerant received at an inlet of the cold-side path by communicating a signal to adjust the degree of opening or closing of the first expansion valve.

11. The controller of claim 9, further operable to:

determine the liquid outlet temperature setpoint based at least in part on a target load capacity of the evaporator.

12. The controller of claim 9, further operable to:

monitor power consumption associated with the liquid outlet temperature setpoint; and adjust the liquid outlet temperature setpoint to a value that reduces the power consumption.

13. The controller of claim 12, further operable to:

use information about a current load of the evaporator and a current ambient environment of the system to determine the value of the liquid outlet temperature setpoint that reduces the power consumption.

14. The controller of claim 9, further operable to:

in response to determining that the system exceeds an operational limit when operating according to the superheat setpoint that was determined based on the liquid outlet temperature setpoint, override the superheat setpoint with an adjusted superheat setpoint that prevents the system from exceeding the operational limit.

15. A method comprising:

determining a liquid outlet temperature setpoint for refrigerant discharged from a liquid outlet of a subcooler, the liquid outlet corresponding to a hot-side path of the subcooler that receives refrigerant directly from a tank, cools the refrigerant by an exchange of heat with a cold-side path of the subcooler that receives the refrigerant from the tank via an inlet expansion valve, and discharges the refrigerant to an evaporator via an outlet expansion valve;

determining a superheat setpoint for the refrigerant discharged to a compressor via a vapor outlet of the cold-side path, the superheat setpoint determined based on the liquid outlet temperature setpoint, and adjusting a temperature of the refrigerant discharged to the compressor via the vapor outlet of the cold-side path based on the superheat setpoint.

16. The method of claim 15, further comprising:

adjusting the temperature of the refrigerant received at an inlet of the cold-side path by communicating a signal to adjust the degree of opening or closing of the first expansion valve.

17. The method of claim 15, further comprising:

determining the liquid outlet temperature setpoint based at least in part on a target load capacity of the evaporator.

18. The method of claim 15, further comprising:

monitoring power consumption associated with the liquid outlet temperature setpoint; and adjusting the liquid outlet temperature setpoint to a value that reduces the power consumption.

19. The method of claim 18, further comprising:

using information about a current load of the evaporator and a current ambient environment of the system to determine the value of the liquid outlet temperature setpoint that reduces the power consumption.

20. The method of claim 15, further comprising:

in response to determining that the system exceeds an operational limit when operating according to the superheat setpoint that was determined based on the liquid outlet temperature setpoint, overriding the superheat setpoint with an adjusted superheat setpoint that prevents the system from exceeding the operational limit.

* * * * *